US006932194B1

(12) United States Patent
Chipman

(10) Patent No.: US 6,932,194 B1
(45) Date of Patent: Aug. 23, 2005

(54) SAFETY RAIL FOR SCAFFOLDING

(76) Inventor: Gary Chipman, P.O. Box 28, Sandown, NH (US) 03873

( * ) Notice: Subject to any disclaimer, the term of this patent is extended or adjusted under 35 U.S.C. 154(b) by 2 days.

(21) Appl. No.: 10/767,746

(22) Filed: Jan. 30, 2004

(51) Int. Cl.[7] ..... A47L 3/02; E04G 1/16; E06C 7/18

(52) U.S. Cl. ..... 182/113; 182/106; 182/112; 182/17

(58) Field of Search ..... 182/113, 106, 17, 182/112, 116, 15, 16, 18, 118, 119, 222, 223, 182/141, 152

(56) References Cited

U.S. PATENT DOCUMENTS

| | | | | |
|---|---|---|---|---|
| 495,810 A | | 4/1893 | Iseminger | 182/59 |
| 2,479,736 A | * | 8/1949 | Fieroh | 182/17 |
| 3,130,814 A | * | 4/1964 | Del Aquila | 182/106 |
| 3,139,155 A | | 5/1964 | Skeels | 182/106 |
| 3,212,605 A | | 6/1964 | Dickerson | |
| 3,675,736 A | | 7/1972 | Roggie | |
| 3,747,706 A | | 7/1973 | Paine | |
| 4,064,999 A | * | 12/1977 | Young | 182/141 |
| 4,088,202 A | | 5/1978 | Costello | |
| 4,263,984 A | * | 4/1981 | Masuda et al. | 182/113 |
| 5,069,309 A | | 12/1991 | Siderski et al. | |
| 5,080,192 A | * | 1/1992 | Kerr | 182/17 |
| 5,121,812 A | | 6/1992 | Ochiai et al. | |
| 5,161,640 A | * | 11/1992 | Holbrooks et al. | 182/113 |
| 5,555,954 A | * | 9/1996 | Swiderski | 182/152 |
| 5,588,500 A | * | 12/1996 | Yonahara | 182/113 |
| 6,039,148 A | * | 3/2000 | Riegel | 182/16 |

FOREIGN PATENT DOCUMENTS

| | | |
|---|---|---|
| JP | 1-121460 A | 5/1989 |
| JP | 2000-345715 A | 12/2000 |
| JP | 2001-73549 A | 3/2001 |
| JP | 2002-188282 A | 7/2002 |
| JP | 2002-220919 A | 8/2002 |
| JP | 2003-20787 A | 1/2003 |
| JP | 2003-64863 | 3/2003 |

* cited by examiner

*Primary Examiner*—Hugh B. Thompson II
(74) *Attorney, Agent, or Firm*—Richard C. Litman

(57) ABSTRACT

A first embodiment of a safety rail for a folding scaffolding cart comprises a single hollow metal tube having two longitudinal ends and shaped to have three smooth 90 degree bends to fit diagonal posts of a folding scaffold. The portable scaffolding cart is a folding platform supported by a rectangular framework having four vertical tube supports with one support tube at each corner. Each support tube has lockable wheels. The vertical supports extend above the platform. The safety rail of the platform connects in an overlapping arrangement to the supports. Alternatively, self-tapping screw fasteners can secure the safety rail. The safety rail is a single shaped tube. Three smooth 90 degree bends in the safety rail allow it to extend upward from a first support, around the perimeter of the platform and back down to a diagonal second support. The safety rail is circular in cross-section, and has a slightly larger diameter than the diameter of the scaffold posts such that each longitudinal end is slotted and sleeved over the first and second diagonal scaffold supports and optionally secured by fasteners. A second embodiment of a safety rail is U-shaped to fit the rear posts of the folding scaffold cart.

20 Claims, 7 Drawing Sheets

SAFETY RAIL FOR SCAFFOLDING

BACKGROUND OF THE INVENTION

1. Field of the Invention

The present invention relates generally to scaffolding. More specifically, the invention is a safety rail adapted for use on a portable foldable construction scaffold.

2. Description of the Related Art

The related art of interest describes various safety devices for portable scaffolding, but none discloses the present invention. There is a need for an effective, economical safety rail device for closing the open upper region of a portable foldable construction scaffolding. The related art will be discussed in the order of perceived relevance to the present invention.

U.S. Pat. No. 495,810 issued on Apr. 18, 1893, to Daniel H. Iseminger describes an external extendible window bracket platform comprising longitudinally slotted bars on both sides of a platform having two transverse bars secured to each end thereof, and having a hand rail extending up from the platform at the window shaped to conform to the rectangular platform and supported by a centered frontal post. A curtain is draped around the handrail. The upper railing of the platform is distinguishable for requiring only a single piece of railing anchored at its ends on the platform by the window and a centered supporting outer post.

U.S. Pat. No. 3,212,605 issued on Oct. 19, 1965, to Robert L. Dickerson describes a portable collapsible wheeled scaffold having two telescopic parallel handrails. The apparatus is distinguishable for requiring a collapsible scaffold with two parallel telescopic handrails.

U.S. Pat. No. 5,121,812 issued on Jun. 16, 1992, to Minoru Ochiai et al. describes a folding wheeled scaffold unit having a second pair of parallel handrails added perpendicular to the scaffold's first parallel handrails by inserting in brackets on the first parallel handrails. The apparatus is distinguishable for requiring a second pair of parallel handrails.

U.S. Pat. No. 5,069,309 issued on Dec. 3, 1991, to Paul R. Swiderski et al. describes a rolling tower scaffold having an upwardly extending fenced-in platform portion comprising a pair of parallel longer railing pieces connected by a pair of hinged end gates. The apparatus is distinguishable for requiring hinged end gates.

U.S. Design Pat. No. 335,354 issued on May 4, 1993, t Bryant E. Phillips describes a ladder handrail comprising an incomplete extended loop attached to one side of a stepladder. The ladder handrail is distinguishable for its required looped shape and attachment to one leg of a stepladder.

U.S. Pat. No. 3,139,155 issued on Jun. 30, 1964, to Le Roy C. Skeels describes a U-shaped and forwardly bent ladder handrail comprising a retractable guard or safety rail that automatically locks in the raised, open, or unfolded position by links on the sides of the stepladder. The apparatus is distinguishable for requiring only a looped handrail attached to a stepladder.

U.S. Pat. No. 3,675,736 issued on Jul. 11, 1972, to William C. Roggie describes a guard rail assembly for a platform comprising a rectangular guard rail having four corner posts extending from the platform of a rectangular post assembly. The guard rail assembly is distinguishable for requiring only a conventional rectangular configuration.

U.S. Pat. No. 3,747,706 issued on Jul. 24, 1973, to David L. Paine et al. describes a portable wheeled folding stepladder riser apparatus for supporting a choir having an upright pair of frames supporting steps and having on top an upright rectangular safety rail supported by the two upright frames. The apparatus is distinguishable for requiring an upright rectangular safety rail.

U.S. Pat. No. 4,088,202 issued on May 9, 1978, to Clifford T. Costello describes a scaffolding cart comprising an electrically steerable scaffolding cart having a vertically positional platform and two parallel handrails transports and supports a workman. The apparatus is distinguishable for requiring two parallel handrails.

Japan Patent Publication No. 1-121460A published on May 15, 1989, to Akikazu Okawa et al. describes an installation method of a safety handrail in a frame trestle scaffold comprising a plurality of handrail units connected together and based in shield tubes on base plates fastened to joists. The handrail units can be telescopic in the horizontal direction. The handrails have an inverted U-shaped frame with upright side tubing. The safety handrails are distinguishable in having a fence-like structure.

Japan Patent Publication No. 2000-345715A published on Dec. 12, 2000, for Yasuyuki Okuda et al. describes a detachable handrail adaptable for different kinds of scaffolds comprising an inverted U-shaped frame with a median cross bar attached to a scaffold by end clamps. The device is distinguishable for requiring an inverted U-shaped frame with a cross bar and end clamps.

Japan Patent Publication No. 2001-73549A published on Mar. 21, 2001, for Yoichi Suzuki describes a hinged corner handrail for a corner section of a prefabricated scaffolding comprising an h-shaped member lying on its short side is hinged at its ends to the scaffolding and telescopically connected to another horizontal pipe. The handrail is distinguishable for being required to be hinged to one end of a scaffold.

Japan Patent Publication No. 2002-188282A published on Jul. 5, 2002, for Atushi Kondo describes a safety handrail for assembling and disassembling prefabricated scaffolding comprising a pair of expandable upright handrail support posts, an expandable horizontal handrail bar connecting the handrail supports, engaging members attached to the handrail supports, and clamps to hold the upright handrail support posts. The safety handrail is distinguishable for requiring only one side protection.

Japan Patent Publication No. 2002-220919A published on Aug. 9, 2002, for Atsushi Kondo describes a safety handrail for a pair of vertical frameworks for a scaffold comprising a vertical rectangular handrail with vertical and horizontal support members. The handrail can be moved vertically and clamped on the scaffolding frame. The handrail is distinguishable for requiring a rectangular frame.

Japan Patent Publication No. 2003-20787A published on Jan. 24, 2003, for Isao Moroto describes a safety fence device for a multi-layer scaffolding apparatus available for high-altitude work comprising a pair of connected horizontal rectangular tubes on vertical bearing leg portions and connected to strut bars that are slidable vertically. The safety fence device is distinguishable for requiring rectangular tubing connected by a bracket at their ends.

None of the above inventions and patents, taken either singly or in combination, is seen to describe the instant invention as claimed. Thus, a safety rail for taper scaffolding solving the aforementioned problems is desired.

SUMMARY OF THE INVENTION

The safety rail for a collapsible taper scaffolding prevents any falling accident in front, and comprises a preformed or prefabricated metal tubular guardrail that is attached to the diametrically opposed upright posts of a folding wheeled scaffolding by overlapping and using fasteners such as screws, cotter pins, or bolts and nuts. The safety rail bends can withstand over approximately 200 lbs. force. The safety rail can be coated with either abrasive and colored non-skid rubber paint in a striped candy-cane coating in pink, orange, red, blue, or yellow colors. The terminal portions of the guardrail can be secured with self-tapping screw fasteners. The scaffolding has an X-shaped foldable hinged frame work that folds in half and between the right and left scaffolding end elements for portage. The upright end elements have four width bars each to support two platform boards having notched bottom ends to secure to two of the width bars to form ascending steps.

Accordingly, it is a principal object of the invention to provide a tubular metal rail device to augment the guardrail of a collapsible portable taper scaffolding according to the present invention.

It is another object of the invention to provide a tubular guardrail comprising a plastic preformed tube that can slip over the ends of the collapsible folding scaffolding having four width bars at each end according to the present invention.

It is a further object of the invention to provide a tubular guardrail secured to the open portion of the collapsible folding scaffolding by slipping over the exposed ends of the scaffolding and fastening, and folding with an X-shaped and hinged structure between the ends according to the present invention.

Still another object of the invention is to provide a tubular guardrail having a coating that is either abrasive, rubber and/or colored secured to the rails of the open portion of a collapsible folding scaffolding, and supporting two platform boards on two different levels to form ascending steps.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
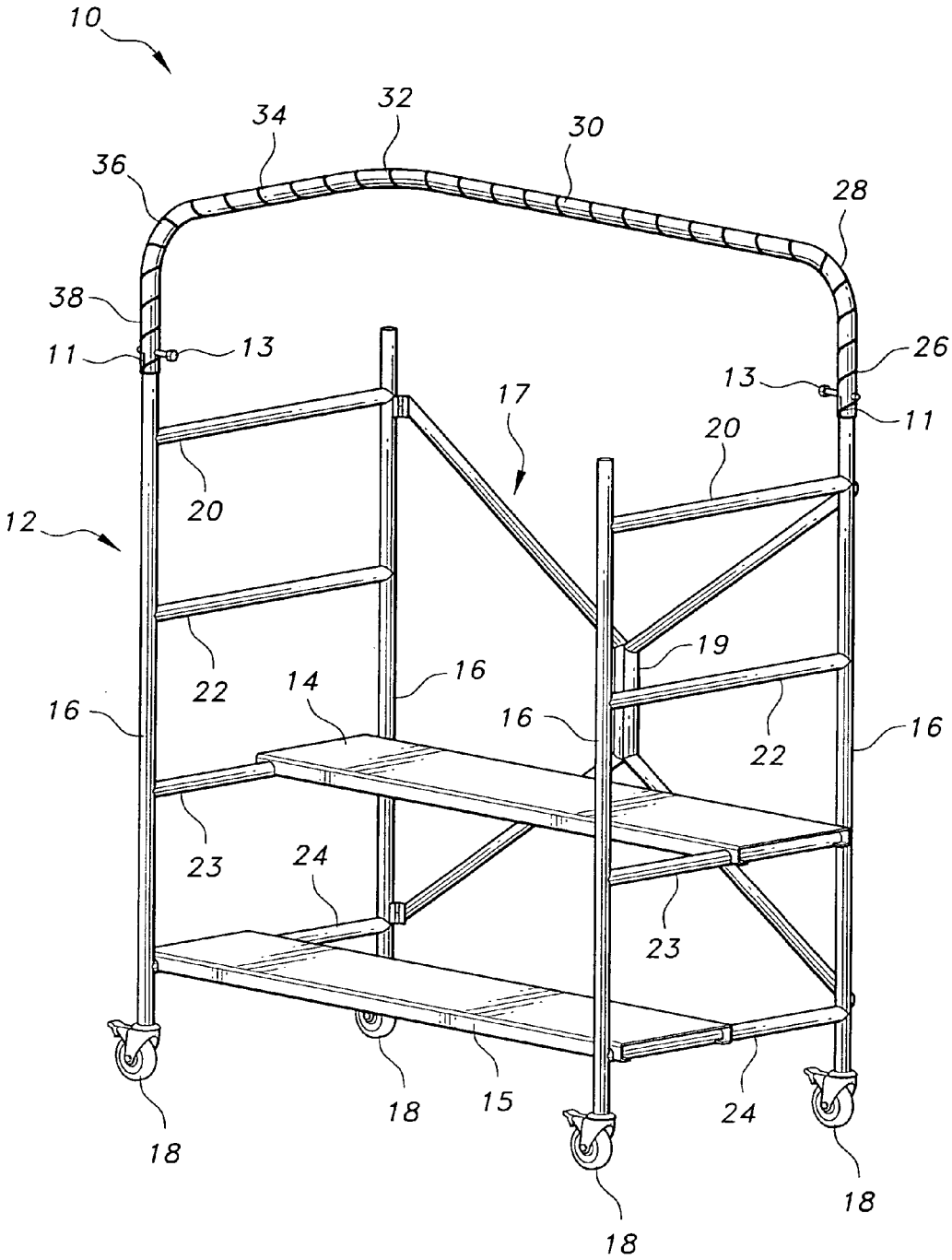
FIG. 1 is a front perspective view of a first embodiment of a safety rail device installed on a folding scaffolding cart having an X-shaped folding support element and two platform boards on different levels to form ascending steps according to the present invention. The safety rail is decorated with a barber pole design to increase the gripping ability of the rail by the workman.
Figure 2:
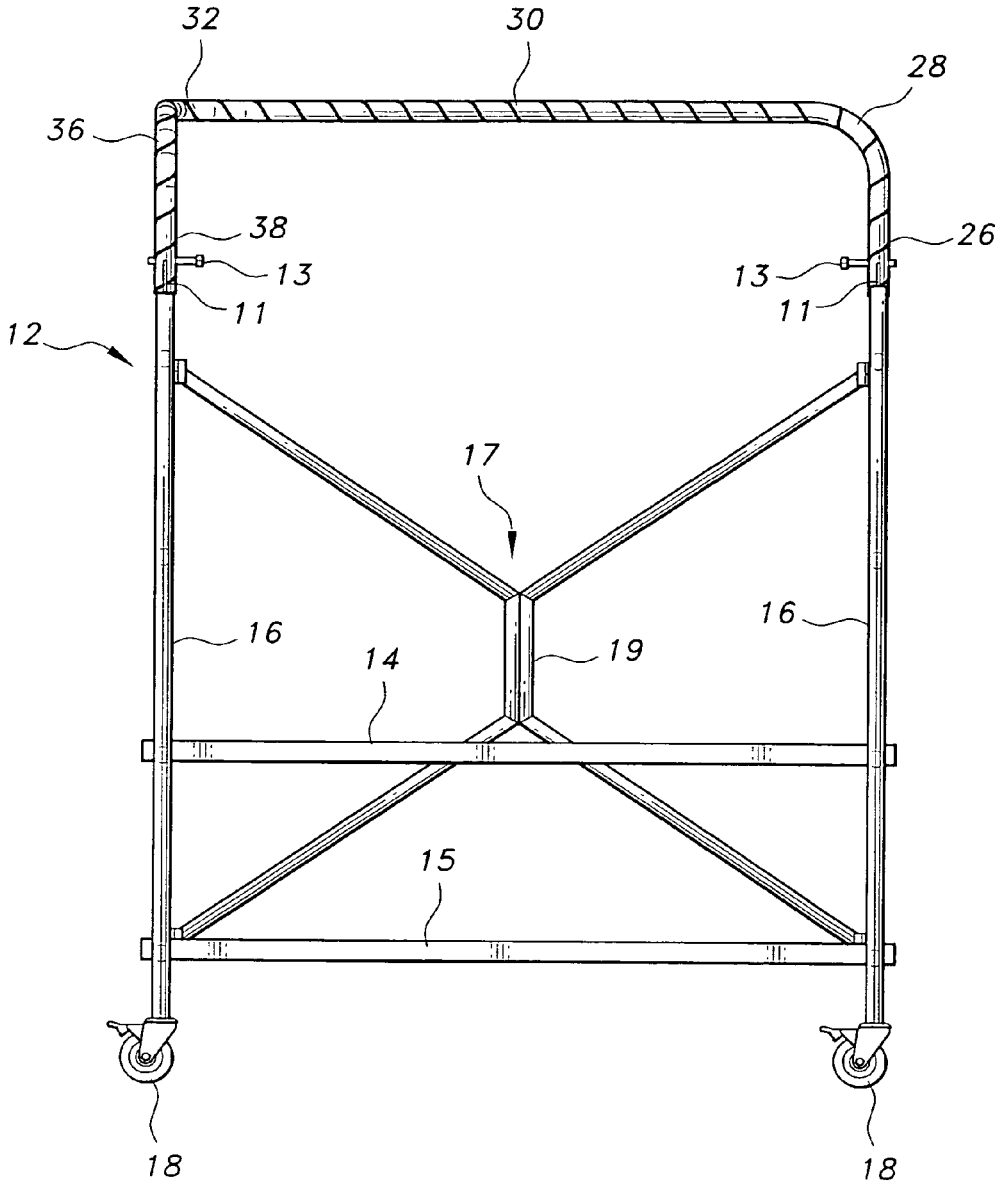
FIG. 2 is a front elevational view of the FIG. 1 safety rail device and the scaffolding cart.
Figure 3:
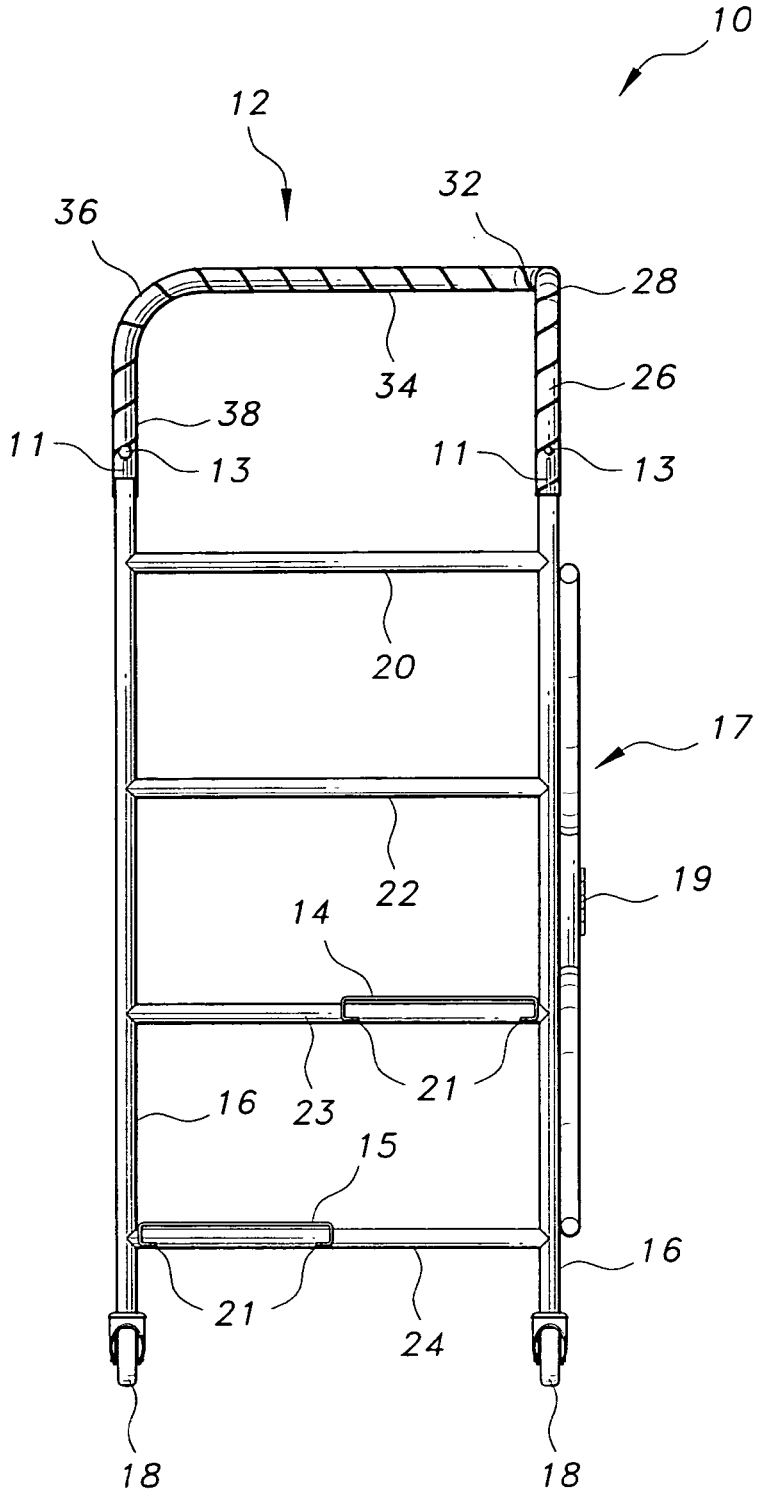
FIG. 3 is a right side elevational view of the FIG. 1 safety rail device and the scaffolding cart.
Figure 4:
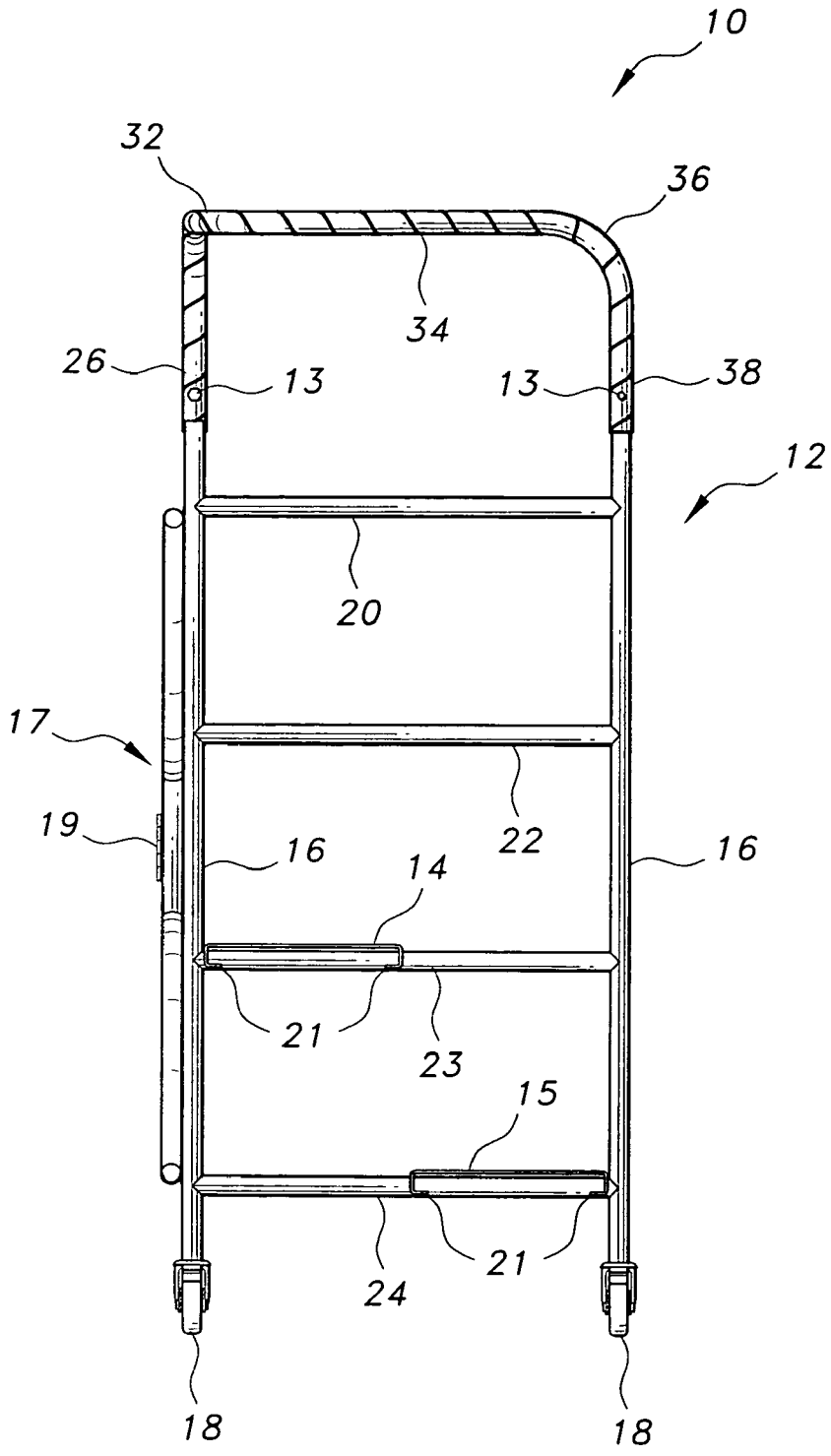
FIG. 4 is a left side elevational view of the FIG. 1 safety rail device and the scaffolding cart.
Figure 5:
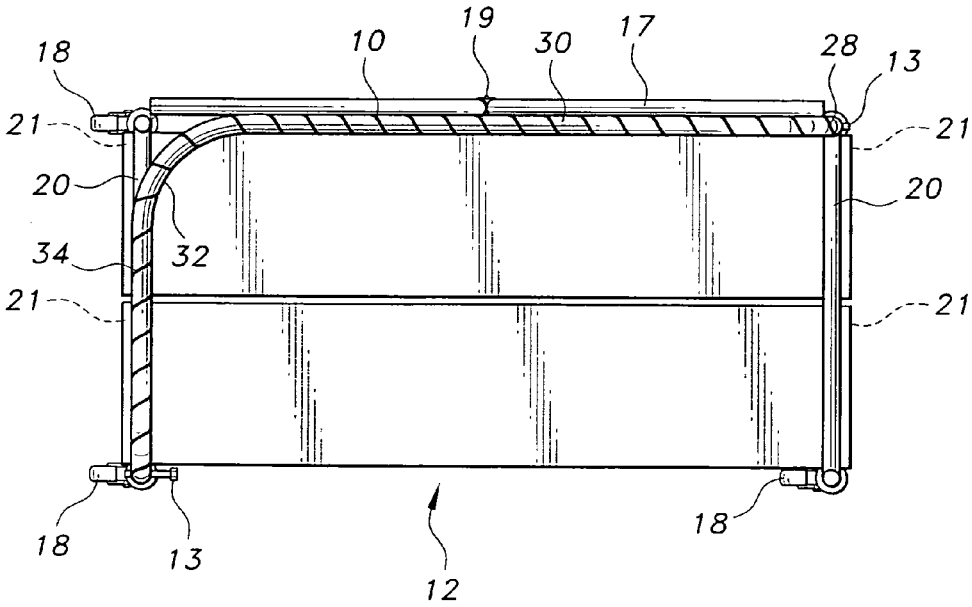
FIG. 5 is a top plan view of the FIG. 1 safety rail device and the scaffolding cart.
Figure 6:
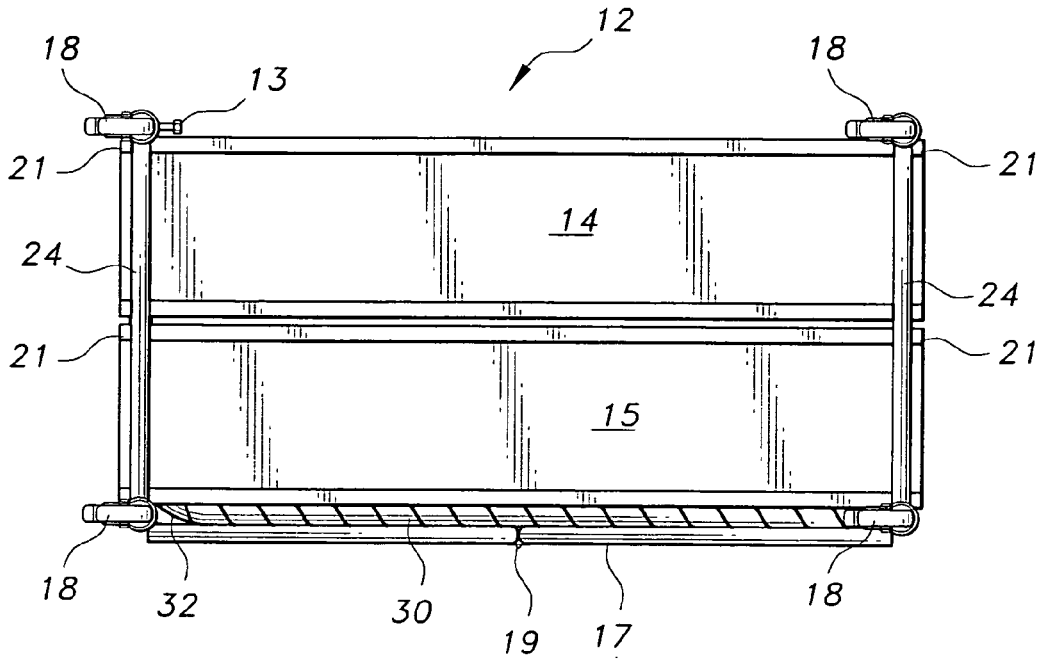
FIG. 6 is a bottom plan view of the FIG. 1 safety rail device and the scaffolding cart.

The present invention is directed a first embodiment in FIGS. 1 to 6 to a safety rail 10 that is preformed to fit a folding cart 12. Two rectangular wooden foot platforms 14 and 15 approximately 11 inches wide are covered by a thick rough surfaced metal layer ⅛ to 3⁄16 inch thick. The platforms 14 and 15 are supported by four tubular metal posts 16 at the corners of the cart 12 having caster wheels 18 and metal width tubes 20, 22, 23, and 24 separating each end post 16 approximately a foot apart in height. The four tubular metal posts 16 support the platforms 14 and 15 having its bottom ends with notches 21 secured on width tubes 23 and 24 to form steps. The four posts 16 extend several inches above the top width tubes 20 at each end. The wheels 18 are approximately 4.5 inches in diameter and have locking elements.

The safety rail 10 consists of a first vertical end portion 26, approximately a first vertical curved 90 degree "soft" bend corner 28, an elongated horizontal portion 30, a second horizontal elongated curved 90 degree portion 32, a horizontal rail portion 34, a third vertical curved 90 degree portion 36 that ends in a vertical end portion 38 overlaps the post 16 diagonally from the front end or the first vertical end portion 26. The safety rail 10 is fastened at its slotted ends 11 onto diagonal posts 16 by either a self-tapping screw 13, a locking pin or a bolt and nut (not shown).

The safety rail 10 provides security for the worker by reminding the worker of his feet location and protection from falling off. The safety rail 10 adds the advantage of facilitating safer travel when occupied by regaining one's balance by holding on to the safety rail when pushed to another location to paint, plaster, and the like. When installing ceiling tile, the safety rail 10 provides the added stabilizing factor. In other words, injury from falls caused by an unprotected upper front portion of the staging cart or off the rear is preventable by the addition of the safety rail 10.

An exemplary dimensions list is as follows:

Safety rail 10: The vertical leg portions 26, 38 are approximately 15 to 24 inches long; the horizontal front portion 30 is approximately 42 inches long; and the horizontal rail portion 34 is approximately 15 to 24 inches long. The metal rail can either be an aluminum electrical conduit pipe, copper tubing, or steel tubing having an inside diameter of approximately 1 inch. The cart 12 can be approximately 42 inches long, 15 to 24 inches wide, and 4 to 6 feet tall. The safety rail 10 can have different measurements to fit different sized carts 12.

Other important coating details of the safety rail 10 can be coating (1) with abrasive material such as sand granules to improve the worker's gripping (see FIG. 7); and (2) diagonal stripes, i.e., coating with a bright colored non-skid rubber-based paint, e.g., pink, orange or yellow, or a patriotic mode such as red, white and blue (FIGS. 1 to 6).

Figure 7:
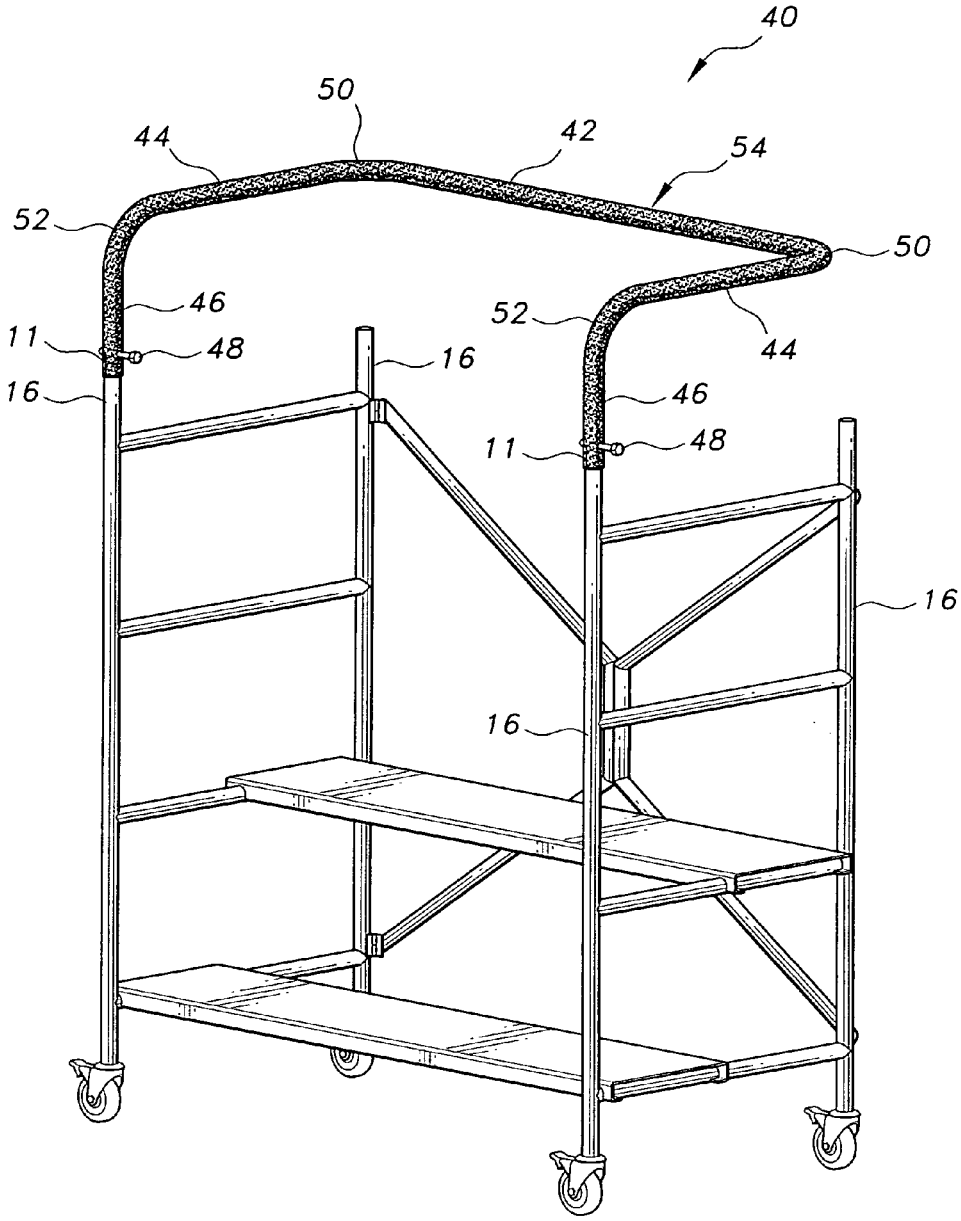
FIG. 7 is a perspective rear view of a second embodiment of a symmetrical safety rail device coated with a roughened coating installed on the folding scaffolding cart of the first embodiment.

The second embodiment in FIG. 7 of a safety rail 40 that is U-shaped and symmetrical in having in front two smooth right-angle bends 50 in the same horizontal plane as the front safety rail segment 42. The two continuing segments 44 form smooth right-angle bends 52 vertically downward to form sleeves 46 over the rear posts 16 to be secured by fasteners 48. The sleeves 46 have diametrically positioned slots 11 to ensure overlapping the rear posts 16. The safety rail 40 is coated with an abrasive composition 54 to enhance the grip for a workman.

Thus, two embodiments of a folding and wheeled cart with differently configured safety rails have been described for furthering the safety of a workman utilizing these carts.

It is to be understood that the present invention is not limited to the embodiments described above, but encompasses any and all embodiments within the scope of the following claims.

I claim:

1. A safety rail and a portable folding scaffolding cart, comprising:

a portable folding scaffolding cart having vertical front and rear portions of equal length, vertical right and left width portions of equal length, two removable rectangular horizontal foot platforms extending from the right width portion to the left width portion, four cylindrical posts at each corner extending the same height, and wheels on each post; and a hollow cylindrical tube configured to extend vertically from and overlap one front corner post, continue with a smooth curve horizontally along a front edge of the scaffolding cart to the opposite corner, have an elongated substantially angled configuration to continue to the adjacent rear corner post, and form a smooth curve vertically down to overlap the proximate rear corner post;

whereby a safety rail is provided traversing two sides of the scaffolding cart to ensure protection for the worker from falling off the scaffolding cart.

2. The safety rail according to claim 1, including a fastening means to adjust its height and to secure vertical ends of the hollow cylindrical tube having slots, to the corner posts.

3. The safety rail according to claim 1, wherein the fastening means is a self-tapping screw.

4. The safety rail according to claim 1, wherein the fastening means is a threaded bolt and nut.

5. The safety rail according to claim 1, wherein the wheels are caster wheels with locking means.

6. The safety rail according to claim 1, wherein the safety rail is coated with an abrasive layer.

7. The safety rail according to claim 1, wherein the ends of the safety rail are slotted for attachment to the posts.

8. The safety rail according to claim 1, wherein the safety rail is made of a metal selected from the group consisting of aluminum, copper and steel.

9. The safety rail according to claim 8, wherein the safety rail is aluminum.

10. The safety rail according to claim 8, wherein the safety rail is copper.

11. The safety rail according to claim 8, wherein the safety rail is steel.

12. A safety rail and a portable folding scaffolding cart, comprising:

a portable folding scaffolding cart having vertical front and rear portions of equal length, vertical right and left width portions of equal length, two removable rectangular horizontal foot platforms extending from the right width portion to the left width portion, four cylindrical posts at each corner extending the same height, and wheels on each post; and a hollow cylindrical U-shaped tube configured to extend vertically from and overlap one rear corner post, continue with a smooth curve horizontally to a front corner of the scaffolding cart, continue with a smooth curve to the opposite front corner, continue with a smooth curve to the adjacent rear corner post, and form a smooth curve vertically down to overlap the proximate rear corner post;

whereby a safety rail is provided traversing three sides of the scaffolding cart to ensure protection for the worker from falling off the scaffolding cart.

13. The safety rail according to claim 12, including a fastening means to adjust its height and to secure vertical ends of the hollow cylindrical tube having slots, to the corner posts.

14. The safety rail according to claim 12, wherein the fastening means is a self-tapping screw.

15. The safety rail according to claim 12, wherein the fastening means is a threaded bolt and nut.

16. The safety rail according to claim 12, wherein the wheels are caster wheels with locking means.

17. The safety rail according to claim 12, wherein the safety rail is coated with an abrasive layer.

18. The safety rail according to claim 12, wherein the ends of the safety rail are slotted for attachment to the posts.

19. The safety rail according to claim 12, wherein the safety rail is made of a metal selected from the group consisting of aluminum, copper and steel.

20. The safety rail according to claim 19, wherein the safety rail is made of steel.

* * * * *